US009033439B2

(12) United States Patent
Tokuda et al.

(10) Patent No.: US 9,033,439 B2
(45) Date of Patent: May 19, 2015

(54) APPARATUS FOR CHARGING POWER STORAGE UNIT PROVIDED IN CARRIAGE HAVING PRINTHEAD, AND CHARGE CONTROL METHOD AND STORAGE MEDIUM STORING PROGRAM THEREOF

(71) Applicant: CANON KABUSHIKI KAISHA, Tokyo (JP)

(72) Inventors: Takamitsu Tokuda, Yokohoma (JP); Masao Mori, Kawasaki (JP); Kimiyuki Hayasaki, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/245,536

(22) Filed: Apr. 4, 2014

(65) Prior Publication Data

US 2014/0307013 A1 Oct. 16, 2014

(30) Foreign Application Priority Data

Apr. 11, 2013 (JP) ..... 2013-083320

(51) Int. Cl.
*B41J 29/38* (2006.01)
*B41J 29/393* (2006.01)
*B41J 23/34* (2006.01)

(52) U.S. Cl.
CPC ..... *B41J 29/393* (2013.01); *B41J 23/34* (2013.01); *B41J 2029/3932* (2013.01)

(58) Field of Classification Search
CPC ... B41J 29/393; B41J 2029/3932; B41J 23/34
USPC ..... 347/19, 5; 358/1.13; 320/107, 166; 324/500
See application file for complete search history.

(56) References Cited

U.S. PATENT DOCUMENTS

| | | | | |
|---|---|---|---|---|
| 5,589,859 | A * | 12/1996 | Schantz | 347/19 |
| 6,108,097 | A * | 8/2000 | Suzuki et al. | 358/1.13 |
| 6,311,436 | B1 | 11/2001 | Mimura et al. | |
| 6,622,026 | B1 | 9/2003 | Ishinaga et al. | |
| 6,770,986 | B2 | 8/2004 | Nagao et al. | |
| 2008/0258680 | A1 * | 10/2008 | Frerking et al. | 320/107 |
| 2009/0096430 | A1 * | 4/2009 | Van Der Linde et al. | 320/166 |
| 2011/0001485 | A1 * | 1/2011 | Feight et al. | 324/500 |

FOREIGN PATENT DOCUMENTS

| | | | |
|---|---|---|---|
| JP | 11-320928 | A | 11/1999 |
| JP | 2009-535007 | A | 9/2009 |
| WO | 2007/121533 | A1 | 11/2007 |

* cited by examiner

*Primary Examiner* — Julian Huffman
*Assistant Examiner* — Carlos A Martinez
(74) *Attorney, Agent, or Firm* — Fitzpatrick, Cella, Harper & Scinto

(57) ABSTRACT

An apparatus including: a control unit configured to control a switch that performs switching between a charging path for charging a first power storage unit provided in a carriage having a printhead mounted thereon by power supplied from a power source and a charging path for charging the first power storage unit by power supplied from a second power storage unit that is provided in a main body of the printing apparatus equipped with the carriage and has a capacity higher than the first power storage unit; and a determining unit configured to determine whether or not the second power storage unit has a power storage capacity less than a threshold value, wherein the control unit controls the switch such that the first power storage unit can be charged by the power supplied from the power source if it is determined by the determining unit that the power storage capacity of the second power storage unit is less than the threshold value.

12 Claims, 8 Drawing Sheets

APPARATUS FOR CHARGING POWER STORAGE UNIT PROVIDED IN CARRIAGE HAVING PRINTHEAD, AND CHARGE CONTROL METHOD AND STORAGE MEDIUM STORING PROGRAM THEREOF

BACKGROUND OF THE INVENTION

1. Field of the Invention

The present invention relates to a printing apparatus including a printhead having a power storage unit, a charge control method and a storage medium storing program thereof.

2. Description of the Related Art

Inkjet printing apparatuses including an electric double-layer capacitor (EDLC) are conventionally known (Japanese Patent Laid-Open No. 11-320928). The EDLC is mounted in, for example, the carriage of an inkjet printing apparatus, and is used as a power source for driving a heater. With this configuration, the need to provide a power supply wire between the main body of the inkjet printing apparatus and the printhead can be eliminated. Furthermore, by configuring the inkjet printing apparatus so as to be capable of transmission and reception of print data and the like through wireless communication using, for example, infrared rays, the need to provide a flexible cable can also be eliminated.

With this configuration, in order to prevent printing from being interrupted, the EDLC is required to have a power storage capacity in such an amount that at least a single page's worth of data can be printed on the printing medium. This is because if an interruption occurs during printing of a page due to recovery processing or the like, the temperature of the printhead drops rapidly during the interruption, resulting in a change in printing density. Such a phenomenon appears pronouncedly in high duty images. Accordingly, the EDLC needs to have a minimum electric power capacity required to print at least a single page's worth of high duty image data. However, such an electric power capacity is relatively large, and as a result, the charging time of the EDLC increases. Also, particularly when continuous page printing is performed, a long standby time is required during printing.

Japanese Patent Laid-Open No. 2009-535007 discloses a configuration in which a high-capacity EDLC is newly provided so as to directly charge a low-capacity EDLC. In such a configuration, when the high-capacity EDLC that has been fully charged and the low-capacity EDLC that has been completely discharged are connected in parallel, a current flows such that the voltages of these EDLCs are uniform. EDLCs have a low equivalent series resistance, and thus charging can be finished in about several to several ten seconds.

In the case where an inkjet printing apparatus in which such a high-capacity EDLC is mounted is unpacked or is left for a long period of time with its power cord plug being unplugged from a power outlet, the high-capacity EDLC needs to be charged. However, it requires a longer charging time than the above-described EDLC that is mounted in the carriage, and as a result, the standby time increases.

SUMMARY OF THE INVENTION

An aspect of the present invention is to eliminate the above-mentioned problems with the conventional technology. The present invention provides a printing apparatus that shortens a standby time caused by charging of a power storage unit, and a charge control method.

The present invention in one aspect provides an apparatus comprising: a control unit configured to control a switch that performs switching between a charging path for charging a first power storage unit provided in a carriage having a printhead mounted thereon by power supplied from a power source and a charging path for charging the first power storage unit by power supplied from a second power storage unit that is provided in a main body of the printing apparatus equipped with the carriage and has a capacity higher than the first power storage unit; and a determining unit configured to determine whether or not the second power storage unit has a power storage capacity less than a threshold value, wherein the control unit controls the switch such that the first power storage unit can be charged by the power supplied from the power source if it is determined by the determining unit that the power storage capacity of the second power storage unit is less than the threshold value.

According to the present invention, it is possible to shorten a standby time caused by charging of a power storage unit.

Further features of the present invention will become apparent from the following description of exemplary embodiments with reference to the attached drawings.

DESCRIPTION OF THE EMBODIMENTS

Figure 1:
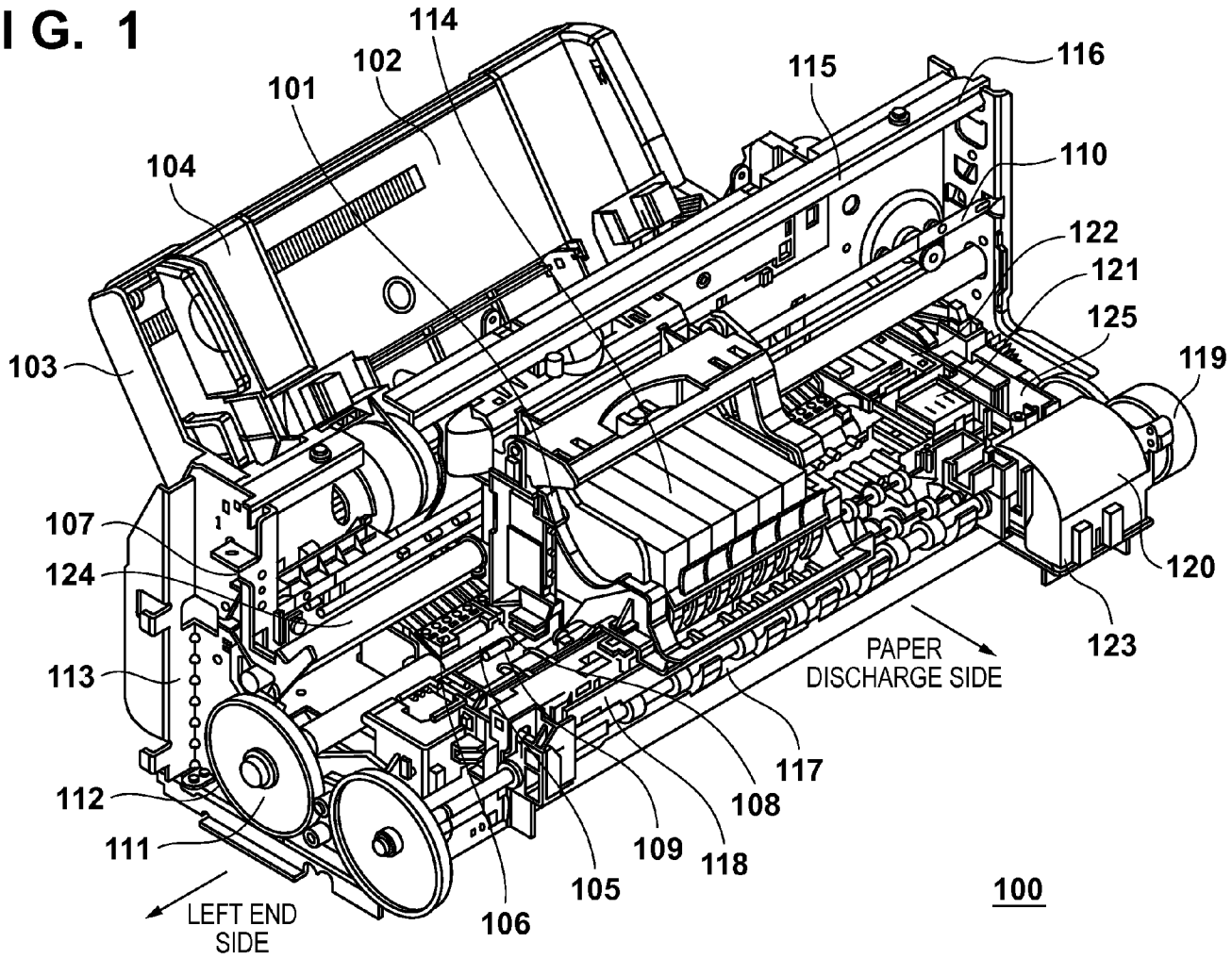
FIG. 1 is a diagram showing a configuration of an inkjet printing apparatus.

Preferred embodiments of the present invention will now be described hereinafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention. The same constituent elements are given the same reference numerals, and a description thereof is omitted.

First Embodiment

FIG. 1 is a diagram showing a configuration of an inkjet printing apparatus according to the present embodiment. The inkjet printing apparatus roughly includes a paper feed mechanism unit, a paper conveying mechanism unit, a paper discharge mechanism unit, a carriage unit, a recovery mechanism unit (cleaning unit), and a control unit. The present embodiment will be described using an inkjet printing apparatus that performs printing by discharging ink droplets from discharging ports (nozzles) formed in a printhead onto a printing medium based on image data or the like that is to be printed, as an example of a printing apparatus. Also, in the present embodiment, a serial-scan type inkjet printing apparatus that reciprocates the printhead in the scanning direction intersecting the conveyance direction of printing medium will be described.

An inkjet printing apparatus 100 includes a carriage 101 that is reciprocated in the scanning direction intersecting the conveyance direction of printing medium. As the printing medium, printing media made of various materials can be used as long as they are in the form of sheets and images can be printed thereon. Examples thereof include paper, plastic sheets, cloth, and non-woven fabric. Hereinafter, printing media in the form of sheets will be referred to simply as "sheets".

Paper Feed Mechanism Unit

The paper feed mechanism unit includes a pressure board 102 on which sheets are loaded, a paper feed roller for feeding sheets, a separation roller for separating sheets, and a return lever for bringing sheets back to the loaded position. They are attached to a paper feed base 103. A paper feed tray for holding loaded sheets is attached to the paper feed base 103 or the exterior of the inkjet printing apparatus 100. The paper feed tray may be composed of multiple trays and pulled out for use. The paper feed roller is a rod-shaped rotary member having an arcuate cross-section. The paper feed roller is provided with one paper feed roller rubber at a position close to the sheet edge reference position. Sheets are fed by the paper feed roller. The paper feed roller is driven by a driving force transmitted from a paper feed motor provided in the paper feed mechanism unit via a drive transmission gear, a planetary gear, and the like.

The pressure board 102 is provided with a movable side guide 104 so as to be capable of being moved to determine the loaded position of sheets. The pressure board 102 is capable of being swung about a supporting shaft attached to the paper feed base 103, and is biased toward the paper feed roller by a pressure board spring. The pressure board 102 facing the paper feed roller is provided with a separation sheet. The separation sheet is provided to prevent multi-feed of a few uppermost sheets of a plurality of loaded sheets, and is made of a material having a large friction coefficient such as artificial leather. The pressure board 102 is configured so as to be capable of abutting with or separating from the paper feed roller by a pressure board cam. Furthermore, a separation roller holder is attached to the paper feed base 103, the separation roller holder pivotally supporting the separation roller to separate sheets one by one. The separation roller holder is capable of rotating about a rotation shaft provided in the paper feed base 103, and is attached in a state of being biased to the paper feed roller by a separation roller spring.

A separation roller clutch (clutch spring) is attached to the separation roller. The separation roller clutch is configured such that upon application of a load of a predetermined value or more onto the separation roller, the portion to which the separation roller is attached is rotated. The separation roller is abutted with or separated from the paper feed roller by a separation roller release shaft and a control cam. The positions of the pressure board 102, the return lever and the separation roller are detected by an ASF sensor. The return lever for bringing sheets back to the loaded position is rotatably attached to the paper feed base 103, and is biased in a releasing direction by a return lever spring. As a result of the return lever being swung by the control cam, sheets are brought back to the loaded position.

The operations of the paper feed mechanism unit will now be described. In a normal standby state, the pressure board 102 is released by the pressure board cam, and the separation roller is released by the control cam. Furthermore, the return lever is held at such a position that brings sheets back to the loaded position and closes a loading opening so that sheets do not reach the rear end when they are loaded. When a paper feeding operation starts in that state, first, the separation roller is brought into abutment with the paper feed roller by driving a motor. Then, the return lever is released to bring the pressure board 102 into abutment with the paper feed roller. In that state, feeding of sheets is started. The sheets are limited by a forefront separation unit provided in the paper feed base 103, and thus only a predetermined number of sheets are conveyed to a nip portion between the paper feed roller and the separation roller. The conveyed sheets are separated by the nip portion, and only an uppermost sheet is conveyed (fed).

When the sheet reaches a conveyance roller pair composed of a conveyance roller 105 and a pinch roller 106, which will be described later, the pressure board 102 is released by the pressure board cam, and the separation roller is released by the control cam. Also, the return lever is brought back to the loaded position by the control cam. At this time, the sheet that has reached the nip portion between the paper feed roller and the separation roller is brought back to the loaded position by the return lever.

Paper Conveying Mechanism Unit

Next, the paper conveying mechanism unit will be described. The paper conveying mechanism unit is attached to a chassis 107 made of a bent metal sheet. The paper conveying mechanism unit includes the conveyance roller 105 that conveys sheets and a PE sensor (paper edge detecting sensor). The conveyance roller 105 has a structure in which the surface of a metal shaft is coated with fine ceramic particles, and is attached to the chassis 107 by its metal shaft portions at opposing ends being pivotally supported by a bearing. A conveyance roller tension spring is provided between the conveyance roller 105 and the bearing so as to bias the conveyance roller 105 to apply a predetermined load. The conveyance roller tension spring implements stable conveyance by applying a load caused by rotation to the conveyance roller 105.

The conveyance roller 105 is provided with a plurality of pinch rollers 106 so as to be in abutment therewith, the pinch rollers 106 being configured to be rotated together with the conveyance roller 105. Each pinch roller 106 is held by a pinch roller holder 108, and as a result of being brought into press contact with the conveyance roller 105 by a pinch roller spring, a force for conveying sheets is generated. The pinch roller holder 108 is capable of being swung about its rotation shaft that is pivotally supported by the bearing of the chassis 107. Furthermore, a paper guide flapper for guiding sheets and a platen 109 are provided at an inlet of the paper conveying mechanism unit to which sheets are conveyed. Also, the pinch roller holder 108 is provided with a PE sensor lever for informing the PE sensor of detection of the leading edge and trailing edge of a sheet. The platen 109 is positioned by being attached to the chassis 107. The paper guide flapper is fitted to the conveyance roller 105 so as to be capable of being swung about a sliding bearing unit, and is positioned by being abutted with the chassis 107. A sheet presser for covering the edge portion of sheets is provided on a side of the platen 109, the side being at the sheet edge reference position. This prevents a sheet having a bent or curled edge from being raised and coming into contact with the carriage 101 or the printhead. Furthermore, on the downstream side of the conveyance roller 105 in the sheet conveyance direction, the printhead for printing images based on image data that is to be printed is provided. A sheet conveyed to the paper conveying mechanism unit is sent to a nip portion between the conveyance roller 105 and the pinch roller 106 by being guided by the pinch roller holder 108 and the paper guide flapper. At this time, the leading edge of the conveyed sheet is detected by the PE sensor lever, and thereby the printing position (recording position, image forming position) in the sheet is calculated.

The sheet is conveyed along an upper surface of the platen 109 by the conveyance roller 105 being rotated by a conveyance motor and the pinch roller 106 being rotated together with the conveyance roller 105. The platen 109 has ribs formed on a surface thereof serving as a conveyance guide surface (reference position in the up and down direction). The ribs are provided to manage the gap (distance) between the sheet and the printhead and to control cockling (wrinkling) of the sheet in cooperation with the paper discharge mechanism unit. This configuration prevents degradation caused by cockling in the image quality of an area of the sheet where printing is performed by the printhead. The conveyance roller 105 is driven by a rotation force generated by a conveyance motor such as a DC motor being transmitted to a pulley 111 provided on the conveyance roller shaft by a timing belt 110.

A code wheel 112 for detecting the amount of conveyance by the conveyance roller 105 is provided on the shaft of the conveyance roller 105. Markings are made at pitches of 150 to 300 dpi on the code wheel 112. An encoder sensor 113 for reading the markings of the code wheel 112 is attached to a portion of the chassis 107, the portion being adjacent to the code wheel 112.

Carriage Unit

The printhead according to the present embodiment is an inkjet printhead. The printhead is equipped with separate ink tanks 114 of respective ink colors in a replaceable manner. Also, the printhead includes discharging port lines formed by arranging a plurality of discharging ports (nozzles). An image is printed on a sheet by driving heaters (heat generation elements) respectively provided in the discharging ports based on print data and selectively discharging ink droplets from the discharging ports. The printhead according to the present embodiment discharges ink droplets from the discharging ports by a change in pressure caused by the growth or contraction of bubbles by film boiling generated in the ink within the discharging ports. At this time, the current value of current flowing through each heater instantaneously becomes very high. Also, when a large number of heaters are simultaneously turned on (heated), for example, a pulsed current of about one to several amperes flows through a power supply wire for driving the heaters and a ground (GND). The voltage required by the heaters is much higher than that of commonly used control systems.

The carriage unit includes the carriage 101 in which the printhead is mounted and that is reciprocated. The carriage 101 is guided/supported so as to be capable of being reciprocated (main scanning) along a guide shaft 124 and a guide rail 115 installed in a direction intersecting the sheet conveyance direction. When the carriage 101 is moved to perform scanning, a carriage encoder mounted in the carriage 101 optically reads an encoder scale 302, and outputs the current position of the carriage 101 as position information. The guide shaft 124 constitutes a guide mechanism for guiding the reciprocation movement of the carriage 101. The guide rail 115 also has a function of maintaining the distance (gap) between the printhead and the sheet at an appropriate value by supporting the rear end portion of the carriage 101. The guide shaft 124 is made of a shaft member attached to the chassis 107, and the guide rail 115 is formed unitary with a part of the chassis 107. A slide sheet 116 made of a thin SUS plate or the like is provided under tension in a sliding portion of the guide rail 115 with the carriage 101 so as to reduce the sliding noise.

Paper Discharge Mechanism Unit

The paper discharge mechanism unit includes two paper discharge rollers. A spur is in press contact with each paper discharge roller so as to be capable of being rotated. By rotating each paper discharge roller in synchronization with the conveyance roller 105, the printed sheet is discharged out of the main body of the inkjet printing apparatus 100. In the present embodiment, the paper discharge rollers are attached to the platen 109. A paper discharge roller provided on the upstream side in the conveyance direction includes a plurality of rubber portions (paper discharge roller rubber) provided on a metal shaft. A first paper discharge roller is driven by a driving force from the conveyance roller 105 being transmitted via an idler gear. A second paper discharge roller 117 includes a plurality of elastic bodies such as elastomer on a resin shaft. The second paper discharge roller 117 is driven by a driving force being transmitted from the first paper discharge roller via the idler gear.

As the spur, for example, a spur integrally formed of a thin SUS plate having a plurality of protrusions therearound and a resin portion is used. The spur is attached to a spur base 118. In the present embodiment, each spur is attached to the spur base 118 via a spur spring. Also, each spur is in press contact with the paper discharge roller by the spring force of the spur spring. There are two types of spurs: the ones that mainly produce a conveyance force of the sheet; and the ones that mainly prevent the sheet from being raised when printing is performed. The spurs that produce a conveyance force are provided in a position corresponding to a rubber portion (paper discharge roller rubber portion, elastic body portion) of the paper discharge roller. The spurs that prevent the sheet from being raised are provided in a position where the rubber portion (paper discharge roller rubber portion) of the paper discharge roller is not provided, such as between rubber portions.

The sheet printed by the printhead of the carriage unit as described above is sandwiched by a nip portion between the paper discharge roller and each spur, discharged out of the main body of the inkjet printing apparatus 100, and then placed on a paper discharge tray. The paper discharge tray has a divided structure composed of a plurality of members, and is pulled out for use. Also, the paper discharge tray is formed to have a height increasing toward the front end thereof and high side edges. With this configuration, the alignment of discharged sheets is improved, and the displacement of the printing surfaces of the sheets is prevented.

Recovery Mechanism Unit

The recovery mechanism unit (cleaning mechanism unit) 123 includes a dedicated recovery motor 119. In the recovery mechanism unit 123, a pump 120 is operated by rotating the recovery motor 119 in one direction, and a press-contact/separation operation of a cap 121 and a wiping operation of a blade 122 are performed by rotating the recovery motor 119 in the other direction. Switching between these operations is performed by a one-way clutch. The pump 120 is, for example, an suction pump that generates a negative pressure by squeezing two tubes connected to the cap 121 by using a pump roller. Then, in a state in which the disharging surface of the printhead is capped, the pump 120 is operated, and thereby suction recovery processing of the printhead is performed. The suction recovery processing performs suction to discharge ink and foreign substances such as sticky ink, bubbles, and dust from the discharging ports of the printhead so as to cleanse the inside of the discharging ports of ink. As a result, ink discharging performance can be maintained and recovered.

The inside of the cap 121 is filled with an ink absorbent for reducing the amount of ink remaining on the discharging surface of the printhead after suction. Also, in order to prevent a negative effect caused by the remaining ink being solidified in the ink absorbent of the cap 121, an empty suction operation for suctioning the remaining ink is performed by operating the pump 120 in a state in which the cap 121 is opened. Waste ink obtained by suction by the pump 120 is collected by a waste ink absorbent provided in a lower part of the inkjet printing apparatus 100.

Various recovery operations of the recovery mechanism unit 123 such as the capping operation of the cap 121, the wiping operation of the blade 122, a valve opening/closing operation between the cap 121 and the pump 120, and the like are controlled by a main cam provided with a plurality of cams on the same shaft. Also, the rotation position of the main cam is detected by a position detection sensor such as a photo-interrupter. In the present embodiment, a blade cleaning operation for removing the ink that has adhered to the blade 122 is performed by the blade 122 coming into contact with a blade cleaner 125 when the blade 122 is moved to a backmost position.

Control Unit

Figure 2:
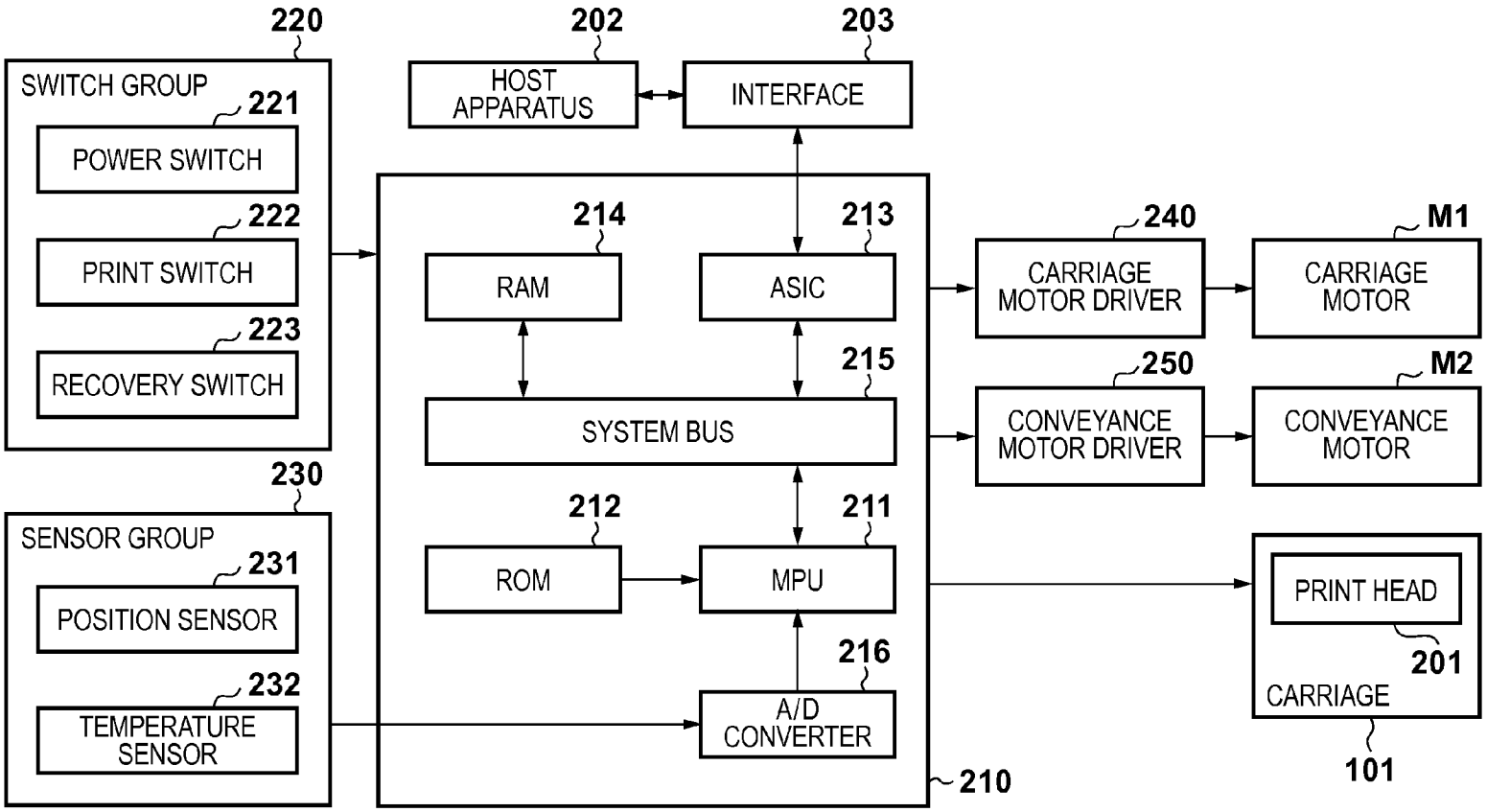
FIG. 2 is a block diagram showing a control configuration of the inkjet printing apparatus.

FIG. 2 is a block diagram showing a control configuration of the inkjet printing apparatus 100 shown in FIG. 1. As shown in FIG. 2, a control unit 210 includes an MPU 211, a program corresponding to a control sequence, which will be described later, a predetermined table, and a ROM 212 in which other fixed data is stored. Also, the control unit 210 includes an application specific integrated circuit (ASIC) 213 that generates control signals for controlling a carriage motor M1, a conveyance motor M2 and a printhead 201, and a RAM 214 including an image data developing area, a work area for executing a program, and the like. Also, the control unit 210 includes a system bus 215 that connects blocks with each other to perform data transfer, and an A/D converter 216 that receives input of an analog signal from a sensor group, which will be described later, performs A/D conversion on the analog signal to obtain a digital signal, and supplies the digital signal to the MPU 211. The printhead 201 shown in FIG. 2 corresponds to the printhead shown in FIG. 1.

Also, in FIG. 2, a host apparatus 202 is a computer (or a reader for reading images, a digital camera or the like) serving as a supply source of image data. Image data, commands, status signals and the like are exchanged between the host apparatus 202 and the inkjet printing apparatus 100 via an interface (I/F) 203.

A switch group 220 includes a power switch 221, a print switch 222 for issuing an instruction to start printing, a recovery switch 223 for issuing an instruction to activate processing (recovery processing) for maintaining the ink discharging performance of the printhead 201 in a good state, and the like. That is, the switch group 220 is composed of switches for receiving input of instructions from the operator. A sensor group 230 includes a position sensor 231 for detecting a home position such as a photocoupler, a temperature sensor 232 provided at an appropriate location in the inkjet printing apparatus 100 so as to detect an environmental temperature, and the like. The sensor group 230 is a group of sensors for detecting the state of the inkjet printing apparatus 100.

Furthermore, a carriage motor driver 240 drives the carriage motor M1 for reciprocate the carriage 101. Also, a conveyance motor driver 250 drives the conveyance motor M2 for conveying sheets. The ASIC 213 transfers data for driving the heat generation elements (heaters) to the printhead 201 while directly accessing a memory area in the ROM 212 during print scanning performed by the printhead 201.

In the inkjet printing apparatus 100 described above, the electric motor portions for driving the mechanism units provided in the main body of the inkjet printing apparatus 100 and the heaters have the highest power consumption. The heaters are pulse-driven, and the wires and power supply apparatus are configured to, from the viewpoint of safety, have an allowance taking into consideration the maximum current of the high-voltage pulse current applied to the heaters. There is a possibility that an inductive interference (noise) due to electromagnetic induction or electrostatic induction occurs between the power supply wire and the signal wire by the pulse current, resulting in a printing failure, and thus various types of measures against noise are taken.

Figure 3:
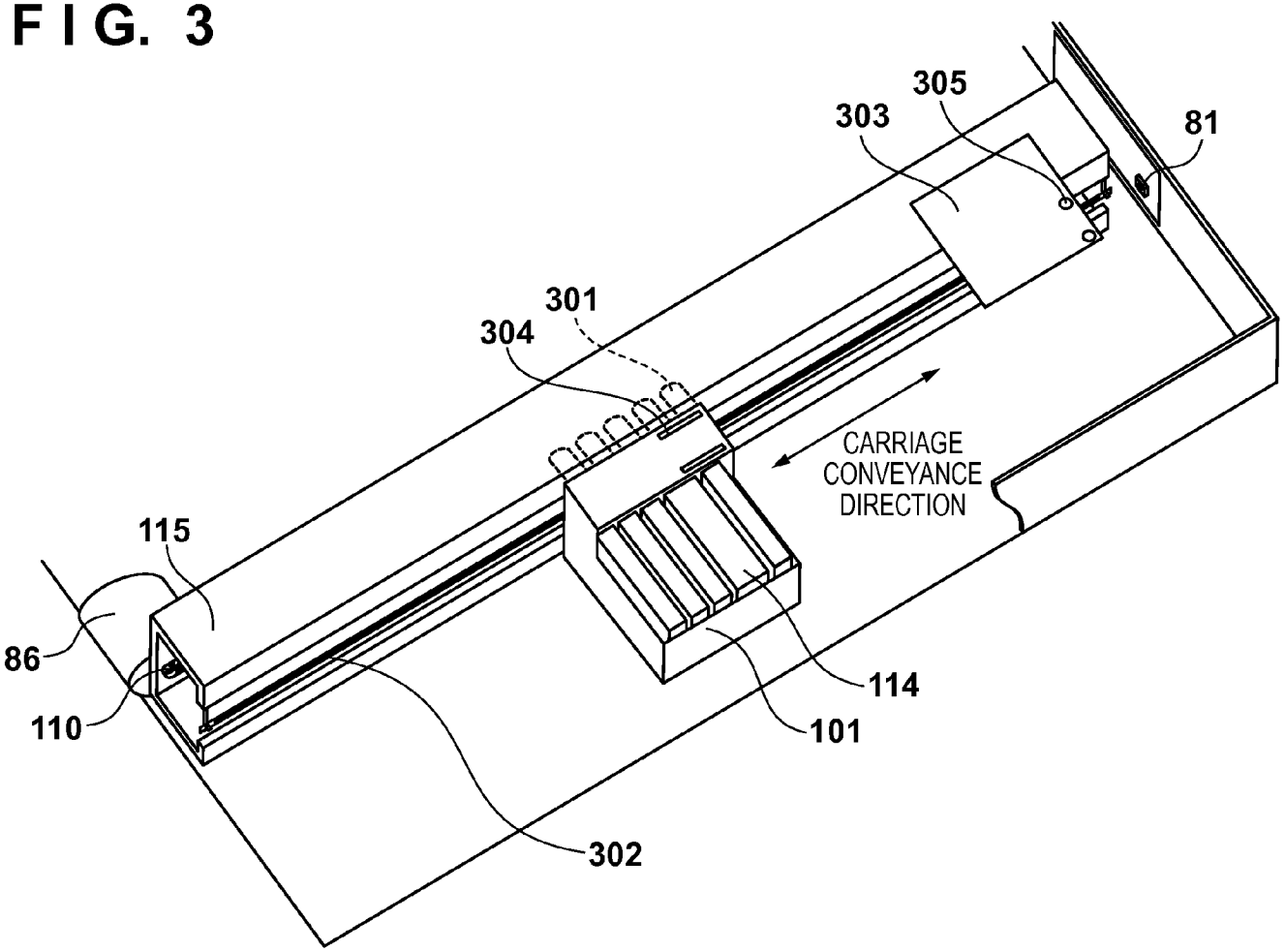
FIG. 3 is a diagram showing a configuration of a periphery of a carriage of the inkjet printing apparatus.

FIG. 3 is a diagram showing a configuration of a periphery of the carriage 101 of the inkjet printing apparatus 100. In the present embodiment, an electric double-layer capacitor (EDLC) 301 is mounted in the carriage 101. In the present embodiment, an EDLC is used as an electrochemical capacitor, but it is also possible to use a lithium ion capacitor. As shown in FIG. 3, the EDLC 301 is provided so as to be covered by the guide rail 115. When the carriage 101 is positioned immediately below a charge substrate 303 (at the home position), a charge terminal 304 comes into contact with a charge pin 305 provided in the charge substrate 303, and thereby charging of the EDLC 301 is performed. The EDLC 301 is small comparing with an electrolyte capacitor, but has a high electrostatic capacity (power storage capacity), and has the following advantages: comparing with a secondary battery, an EDLC can be used under the circumstance in which charge and discharge are frequently performed (the cycle life is, for example, 500,000 cycles); rapid charge and discharge is possible; the environmental load is low; the safety is high; and the like. Because of such features, EDLCs have a variety of applications such as auxiliary power sources for hybrid electric vehicles and the like, regenerative power storage apparatuses, alternative devices for secondary batteries, and energy buffers for solar power generation.

In the inkjet printing apparatus 100, the EDLC 301 is mounted in the carriage 101, and data communication such as print data is performed through wireless communication using infrared rays or the like. Accordingly, as shown in FIG. 3, a flexible cable is unnecessary. Consequently, the influence of noise caused by the pulsed current for driving the heaters can be reduced.

Also, in the inkjet printing apparatus 100, in order to shorten the charging time of the EDLC 301, a high-capacity EDLC is provided in the main body of the inkjet printing apparatus 100 so as to directly charge the EDLC 301. When the EDLC provided in the main body in its fully charged state is connected in parallel to the EDLC 301 that has been discharged, a current flows such that the voltages of these EDLCs are uniform. Generally, EDLCs have a low equivalent series resistance, and thus the charging of the EDLC 301 can be finished in about several to several ten seconds. In the present embodiment, the EDLC provided in the main body is capable of not only charging the carriage 101, but also supplying driving power to the inkjet printing apparatus 100. This configuration enables the use of a lower rated AC adapter.

Consideration is given to a case where, for example, the inkjet printing apparatus 100 is unpacked or is left for a long period of time with its power cord plug being unplugged from a power outlet. In such a case, if the EDLC provided in the main body has been discharged, first, it is necessary to charge the EDLC provided in the main body to a state close to a fully charged state. However, the EDLC provided in the main body has a capacity much higher than that of the EDLC 301 provided in the carriage 101, and thus charging takes 10 minutes or more, resulting in a longer initial standby time than the conventional printing apparatuses.

Accordingly, in the present embodiment, when the EDLC provided in the main body is in a discharged state, the EDLC provided in the main body is bypassed to preferentially charge the EDLC 301 provided in the carriage 101. With this configuration, only the time required to charge the EDLC 301 provided in the carriage 101 is necessary as the initial standby time. After completion of charging of the EDLC 301 provided in the carriage 101, the charging operation is then performed on the EDLC provided in the main body. At this point in time, power is supplied to each mechanism unit provided in the main body of the inkjet printing apparatus 100 directly from the AC adapter. Accordingly, the conveyance speed or the like may decrease due to the rated capacity of the power source not reaching a sufficient level until charging of the EDLC provided in the main body is complete, but printing processing can be started.

As the power supply configuration of the inkjet printing apparatus 100, the electric motors, the heaters and the like require a high voltage power supply of about 24 to 32 V, and the control systems/sensor systems require a low voltage power supply of about 3 to 5 V. As the approximate power consumption of the inkjet printing apparatus 100, the heaters require a power consumption of about 10 W when printing a high duty image, the electric motors require a power consumption of about 20 W when a blank (no-printing) portion of the sheet is forwarded, and the standby power after the inkjet printing apparatus 100 is powered on is about 12 W. Also, the power required to perform a recovery operation is about 20 W when the pump is driven, and the recovery operation takes about three minutes. The power required to perform a pre-discharging operation is about 10 W, and the pre-discharging operation takes about ten seconds.

Generally, a single EDLC has a maximum output voltage of about 2.3 to 2.7 V, and thus the output voltage of the EDLC is raised by a voltage boosting circuit in order to generate a high voltage for the electric motors and the heaters. Also, the power source for the heaters and the like is required to have accuracy with a voltage fluctuation of 2% or less, and thus a circuit for stabilizing the output voltage of the EDLC is provided.

A description will now be given of the capacities of the EDLC provided in the main body and the EDLC 301 provided in the carriage 101 and an example of the charging time of each EDLC. First, a voltage boosting circuit for generating a voltage (24 to 32 V) required by the electric motors and the heaters and a step-down circuit for generating a voltage (3 to 5 V) required by the control systems/signal systems/sensor systems and the like are provided at positions farther from the power source than the EDLCs are. Accordingly, in order to set the voltage boosting circuit to have an input voltage range as wide as 5 to 15 V, and the step-down circuit to have an input voltage range of 3 to 14 V, for both the EDLC provided in the main body and the EDLC 301 provided in the carriage 101, five EDLCs, each having a rated voltage of 2.7 V, are connected in series.

A capacity C of the EDLC provided in the main body, a rated voltage $V_1$ of the EDLC, a lower limit input voltage $V_2$ of the voltage boosting circuit, and the amount of energy U within the actual working voltage range have a relationship represented by Equation (1).

$$U=\tfrac{1}{2}\times C(V_1^2-V_2^2) \quad (1)$$

In the present embodiment, it is known in advance that when each EDLC provided in the main body has a capacity of about 350 F, a driving power of about 30 W can be supplied to the main body of the inkjet printing apparatus 100 for about three minutes. It is also known that when each EDLC 301 provided in the carriage 101 has a capacity of about 10 F, a driving power of about 10 W can be supplied for about ten seconds when printing a high duty image.

If the EDLC provided in the main body in a fully charged state and the EDLC 301 provided in the carriage 101 in a completely discharged state are connected, the following Equation (2) is obtained.

$$\tfrac{1}{2}\times C_1(V_1^2-V_2^2)=\tfrac{1}{2}\times C_2V_2^2 \quad (2)$$

In the above equation, $V_1$ represents the rated voltage of the EDLC provided in the main body, and $C_1$ represents the capacity of the EDLC provided in the main body. Also, $V_2$ represents the voltage of the EDLC provided in the main body/the EDLC 301 provided in the carriage 101 after completion of charging, and $C_2$ represents the capacity of the EDLC 301 provided in the carriage 101.

In the case of the above example, the output voltage of the EDLC 301 provided in the carriage 101 is 2.66 V, and the EDLC 301 provided in the carriage 101 can be charged to about 99% of the rated voltage. The charging takes 5 to 10 seconds. However, the power is not consumed to reach a completely discharged level during actual printing operation, and thus the time it takes for charging can be further shortened.

The charging time required to charge the EDLC provided in the main body by constant current charging at 1 A from a completely discharged state to a fully charged state is calculated by CV=IT on the assumption that the rated voltage of the main body EDLC is 2.7 V and the capacity thereof is 350 F, a charging time of about 16 minutes is obtained, which is the charge standby time. In the above equation, C represents the capacity of the EDLC, V represents the rated voltage of the main body EDLC, I represents the charge current, and T represents the charging time. Furthermore, because initial operations such as the recovery operation of the printhead are performed after that, it takes about 20 minutes from when the inkjet printing apparatus 100 is powered on to when printing can actually be performed.

Likewise, the charging time of the EDLC 301 provided in the carriage 101 having a lower capacity than the EDLC provided in the main body is determined in the same manner. With the above equation on the assumption that the rated voltage of the EDLC 301 provided in the carriage 101 is 2.7 V and the capacity thereof is 10 F, a charging time of about 27 seconds is obtained to charge the EDLC 301 provided in the carriage 101 at a constant current of 1 A from a completely discharged state to a fully charged state. The printhead can be driven when the EDLC 301 provided in the carriage 101 has been charged. Accordingly, in the case where the main body of the inkjet printing apparatus 100 is unpacked and driven by a commercial power source, the charge standby time from when the inkjet printing apparatus 100 is powered on to when printing can actually be performed can be significantly shortened from about 20 minutes to about 27 seconds.

Figure 4:
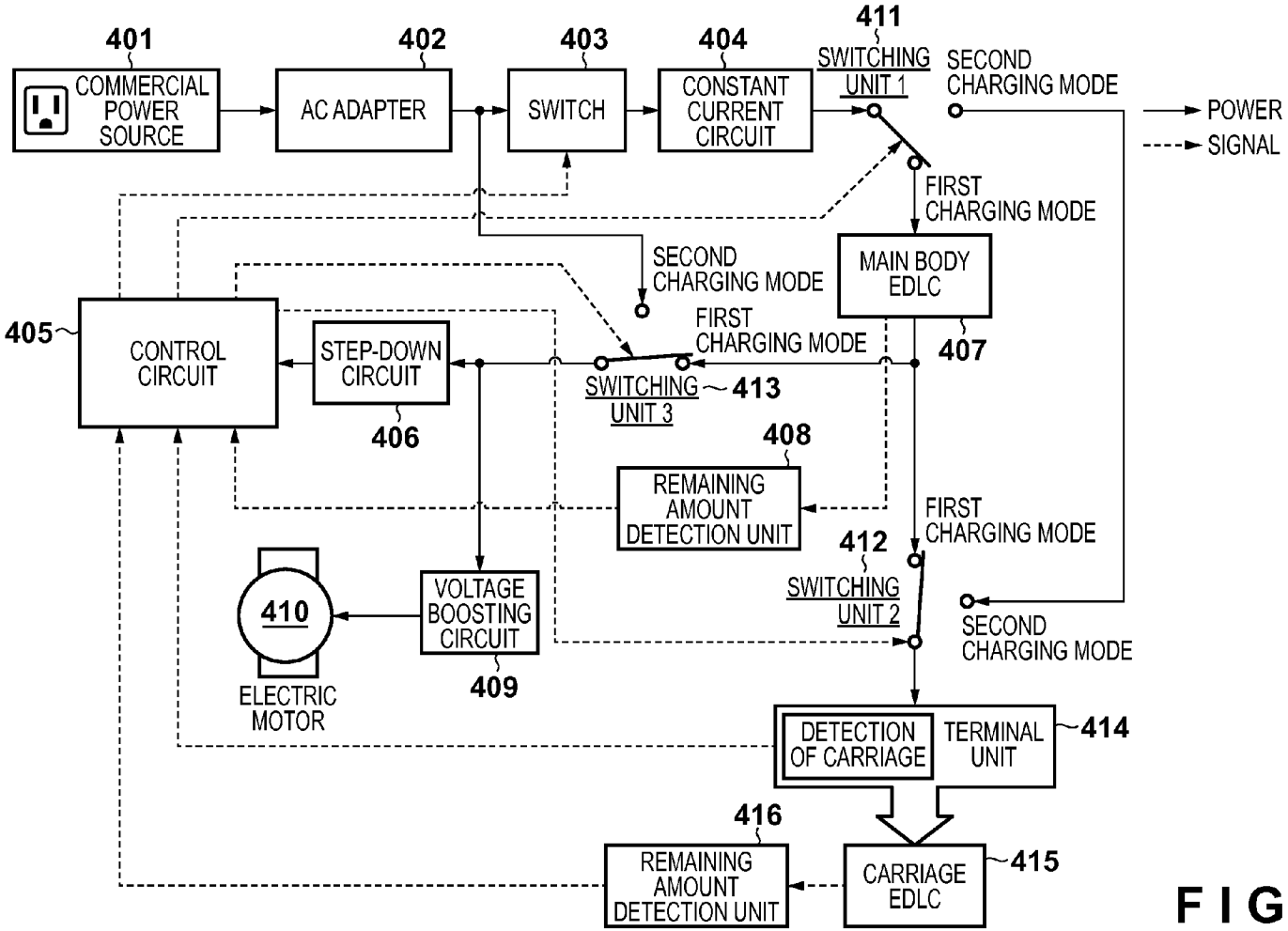
FIG. 4 is a diagram showing a functional block configuration for charging EDLCs.

FIG. 4 is a diagram showing a functional block configuration for charging EDLCs according to the present embodiment. An AC adapter 402 reduces and rectifies the voltage of a commercial power source 401. A control circuit 405 performs overall control on the inkjet printing apparatus 100, and corresponds to the control unit 210 shown in FIG. 2. A constant current circuit 404 supplies a constant current for charging a main body EDLC 407 (an example of a second power storage unit) and a carriage EDLC 415 (an example of a first power storage unit). A remaining amount detection unit 408 detects the output voltage of the main body EDLC 407, and outputs the detected voltage to the control circuit 405. A remaining amount detection unit 416 detects the output voltage of the carriage EDLC 415, and outputs the detected voltage to the control circuit 405. A switch 403 interrupts the power supply from the commercial power source 401 to the main body EDLC 407 when the main body EDLC 407 reaches a fully charged state. A step-down circuit 406 reduces the output voltage of the main body EDLC 407 to a level required by the control circuit 405. A voltage boosting circuit 409 increases the output voltage of the main body EDLC 407 to a level required by an electric motor 410. A terminal unit 414 detects a contact of the carriage 101, and notifies the control circuit 405 of the contact. With switching units 411, 412 and 413, a charging path through which the main body EDLC 407 can be charged and a charging path through which the carriage EDLC 415 can be charged can be switched between a first charging mode and a second charging mode.

In the case of charging the main body EDLC 407, the switching unit 411 is set to the first charging mode. At this time, if the switch 403 is opened, power is supplied from the AC adapter 402 to the main body EDLC 407 via the constant current circuit 404, and thereby the main body EDLC 407 is charged. In the case of performing rapid charging of the carriage EDLC 415 from the main body EDLC 407, the switching unit 412 is set to the first charging mode. In the case of charging the carriage EDLC 415 directly from the commercial power source 401, the switch 403 is opened, and the switching units 411 and 412 are set to the second charging mode. Also, in the case of driving the main body of the inkjet printing apparatus 100 directly with the commercial power source 401, the switching unit 413 is set to the second charging mode.

Figure 5:
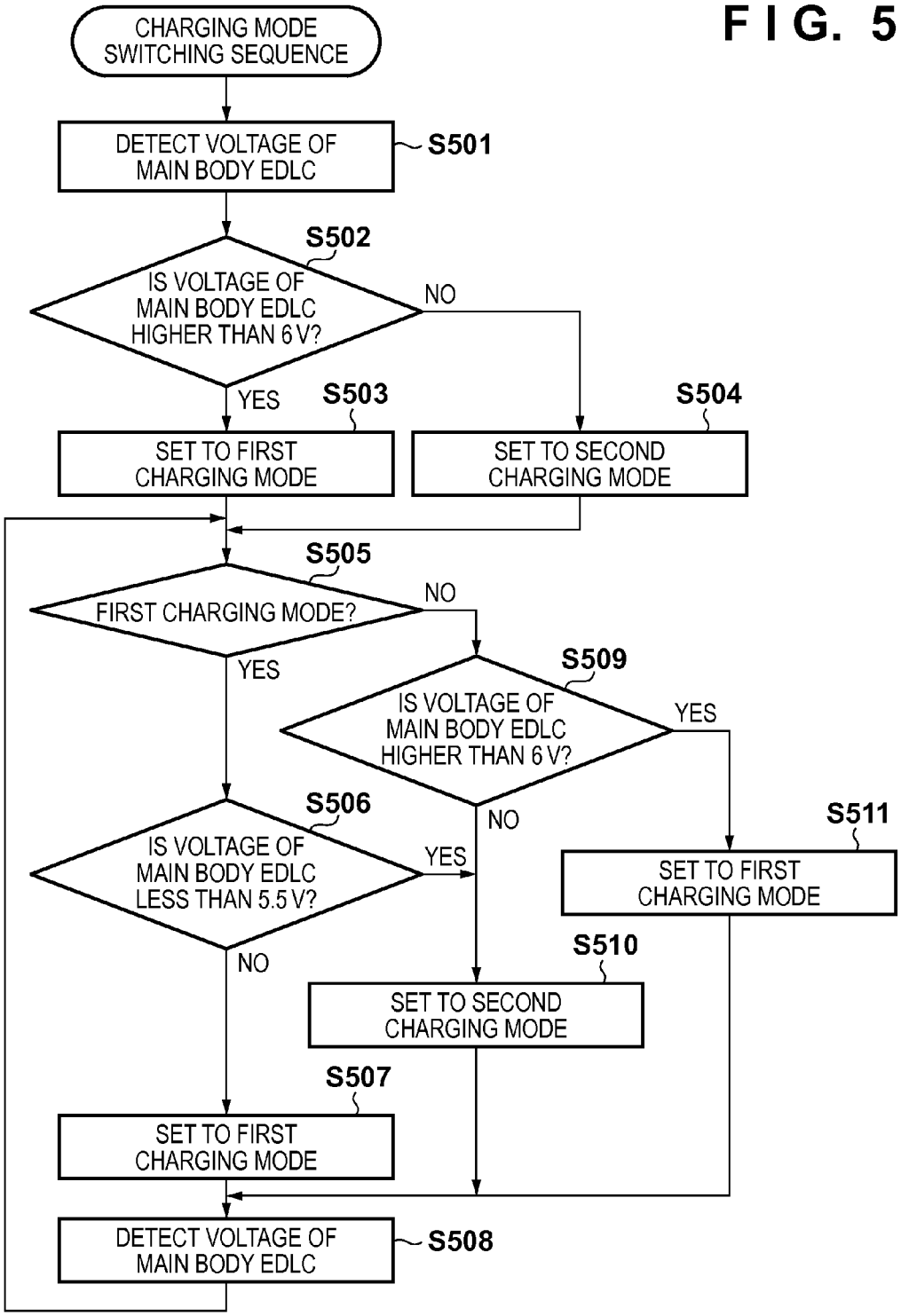
FIG. 5 shows a flowchart illustrating a procedure of charge control processing.

FIG. 5 shows a flowchart illustrating an example of a procedure of charge control processing according to the present embodiment. Each processing shown in FIG. 5 is implemented by, for example, the control circuit 405 shown in FIG. 4 controlling the constituent elements. First, when the inkjet printing apparatus 100 is powered on, in order to initialize the charging mode, an output voltage of the main body EDLC 407 is detected (step S501). Next, it is determined whether or not the output voltage of the main body EDLC 407 is, for example, higher than the lowest input voltage of the voltage boosting circuit 409 by 5% (for example, 6 V) or more (step S502). If it is determined here that the output voltage of the main body EDLC 407 is higher than the lowest input voltage of the voltage boosting circuit 409 by 5% or more, the switching units 411 to 413 are switched to the first charging mode for charging the main body EDLC 407 (step S503). If, on the other hand, it is determined that the output voltage of the main body EDLC 407 is less than a voltage that is higher than the lowest input voltage of the voltage boosting circuit 409 by 5% or more, the switching units 411 to 413 are switched to the second charging mode for charging the carriage EDLC 415 instead of the main body EDLC 407 (step S504).

Next, it is determined whether or not the charging mode currently set in the switching units 411 to 413 is the first charging mode or the second charging mode (step S505). If it is determined that the currently set charging mode is the first charging mode, the procedure advances to step S506. In step S506, it is determined whether or not the output voltage of the main body EDLC 407 is higher than the lowest input voltage of the voltage boosting circuit by 4% (for example, 5.5 V) or more (step S506). If it is determined here that the output voltage of the main body EDLC 407 is higher than the lowest input voltage of the voltage boosting circuit by 4% or more, the switching units 411 to 413 remain in the first charging mode (step S507). If, on the other hand, it is determined that the output voltage of the main body EDLC 407 is less than a voltage that is higher than the lowest input voltage of the voltage boosting circuit by 4% or more, the switching units 411 to 413 are switched to the second charging mode (step S510).

Also, if it is determined in step S505 that the currently set charging mode is the second charging mode, the procedure advances to step S509. In step S509, it is determined whether or not the output voltage of the main body EDLC 407 is higher than the lowest input voltage of the voltage boosting circuit 409 by 5% (for example, 6 V) or more (step S509). If it is determined that the output voltage of the main body EDLC 407 is higher than the lowest input voltage of the voltage boosting circuit 409 by 5% or more, the procedure advances to step S511, where the settings of the switching units 411 to 413 are switched to those for the first charging mode. If, on the other hand, it is determined that the output voltage of the main body EDLC 407 is less than a voltage that is higher than the lowest input voltage of the voltage boosting circuit 409 by 5% or more, the procedure advances to step S510, where the settings of the switching units 411 to 413 remain in the second charging mode. After steps S507, S510 and S511, in step S508, the output voltage of the main body EDLC 407 is detected, and processing from step S505 is repeated.

Through the processing shown in FIG. 5, the output voltage of the main body EDLC 407 is detected, and if the output voltage is less than a predetermined threshold value, the settings of the switching units 411 to 413 are set such that the carriage EDLC 415 is charged in the second charging mode. Also, through the processing shown in FIG. 5, even if there is some fluctuation (for example, 5.5 to 6 V) in the detected output voltage of the main body EDLC 407, by preparing a plurality of threshold values, the settings of the switching units 411 to 413 that have been set once can be maintained in a stable manner. For example, even if it is determined that the output voltage of the main body EDLC 407 is 6 V or more, due to the operation of the carriage 101 or the control circuit 405, the output voltage may instantaneously drop to less than 6 V. Accordingly, if the threshold value has been uniquely set to, for example, 6 V, a situation occurs in which even when the settings of the switching units 411 to 413 are set to those for the first charging mode after it has been temporarily determined that the output voltage is greater than or equal to the threshold value (6 V), the settings of the switching units 411 to 413 are set to those for the second charging mode if the output voltage that has slightly fluctuated to less than 6 V is detected. That is, despite the fact that there is no problem in charging the main body EDLC 407, settings are made to charge the carriage EDLC 415. In the present embodiment, a plurality of threshold values are prepared as in FIG. 5, and thus the settings of the switching units 411 to 413 can be stabilized while allowing the fluctuation in the output of the main body EDLC 407 to some extent.

The settings for the first charging mode of the switching units 411 to 413 will be described. The first charging mode is the charging mode set when it is determined that there is a sufficient amount of remaining voltage (for example, 6 V or more) in the main body EDLC 407. First, as shown in FIG. 4, the switching units 411 and 413 are switched to the first charging mode so as to charge the main body EDLC 407 from a commercial power source. At this time, the switching unit 412 is set to the second charging mode if the carriage 101 is not in contact with the terminal unit 414. In this charging mode, it has been determined that the remaining voltage is sufficient, and thus the charge standby time of the main body EDLC 407 does not become a problem. In the case where the remaining amount detection unit 408 detects that the main body EDLC 407 has been fully charged, the switch 403 is closed to stop the charging of the main body EDLC 407. In this charging mode, the power for driving the main body of the inkjet printing apparatus 100 (the control circuit 405 and the like) can be supplied from the main body EDLC 407. In the case where the remaining amount detection unit 408 detects that the main body EDLC 407 has reached to a voltage less than a predetermined voltage (for example, 6 V), the switch 403 is opened to charge the main body EDLC 407.

Figure 6:
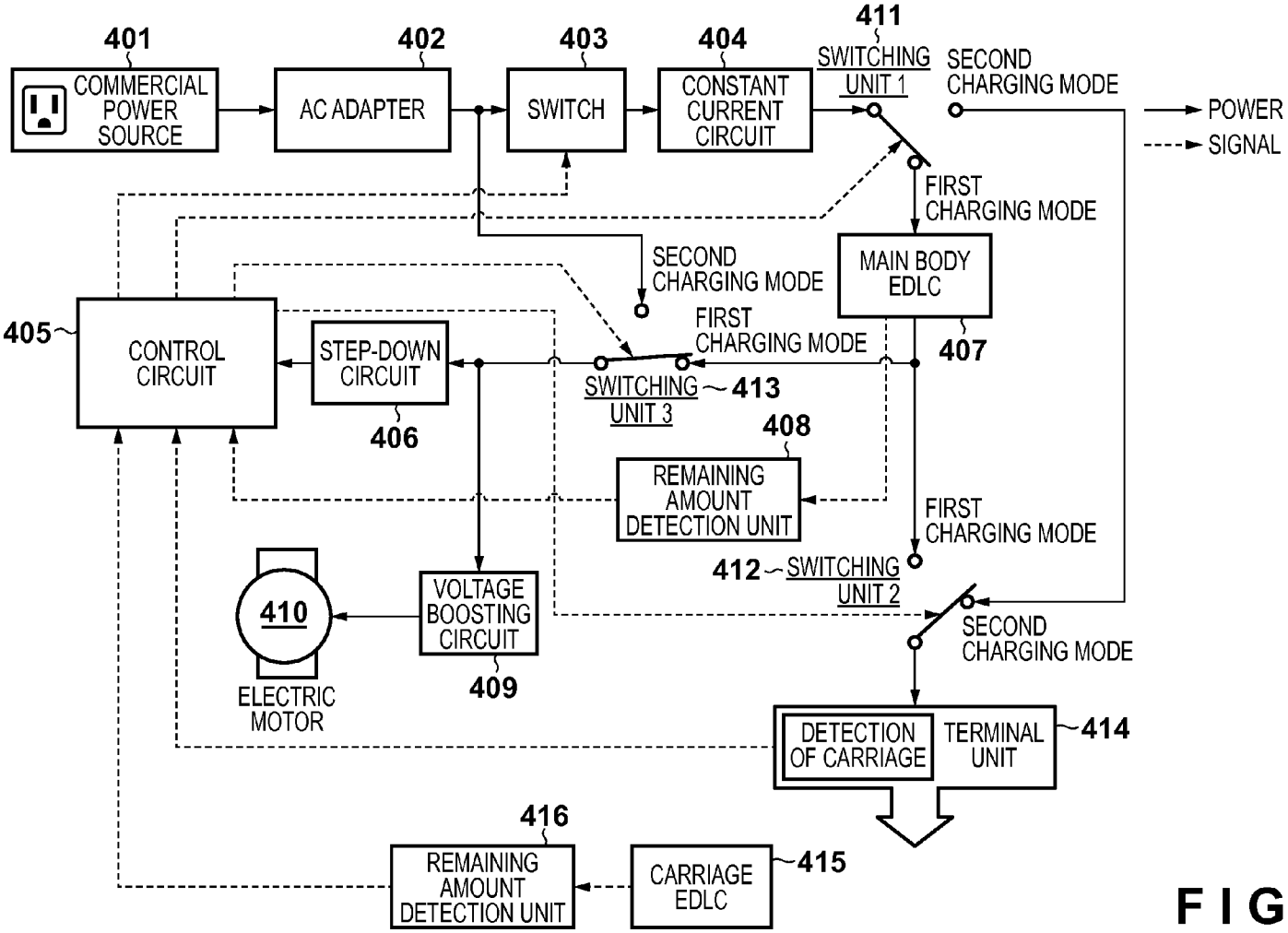
FIG. 6 is a diagram illustrating settings of switching units in the case where the carriage is moved away.

In the case where it has been detected that that the carriage 101 has been brought into contact with the terminal unit 414 during or after charging of the main body EDLC 407, the switching unit 412 is set to the first charging mode. At this time, the carriage EDLC 415 and the main body EDLC 407 are directly connected in parallel via the terminal unit 414, and thus rapid charging from the main body EDLC 407 to the carriage EDLC 415 is instantaneously performed. Also, in the case where the remaining amount detection unit 416 detects that the carriage EDLC 415 has been fully charged and that the carriage 101 has been moved away from the terminal unit 414, the switching unit 412 is switched to the second charging mode as shown in FIG. 6. It is thereby possible to prevent arc discharge at the terminal unit 414.

Figure 7:
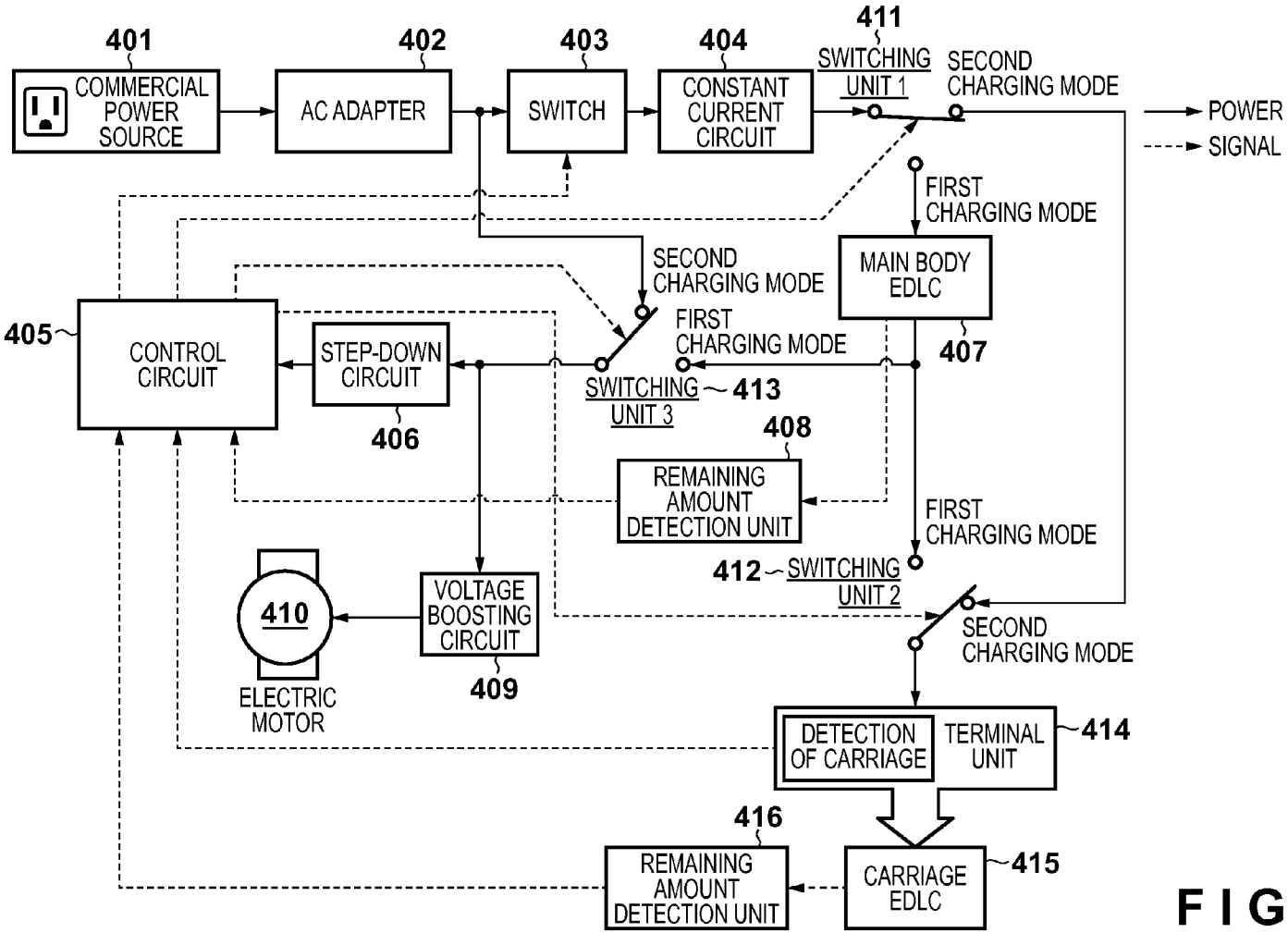
FIG. 7 is a diagram illustrating settings of the switching units that are set for a second charging mode.

Next, the settings for the second charging mode of the switching units 411 to 413 will be described. The second charging mode is the charging mode set when the remaining voltage of the main body EDLC 407 is insufficient (for example, less than 6 V). First, as shown in FIG. 7, the switching units 411, 412 and 413 are switched to the second charging mode so as to open the switch 403. At this time, the carriage EDLC 415 is charged directly from the commercial power source 401 via the constant current circuit 404, and at the same time, power is supplied to the control circuit 405.

Figure 8:
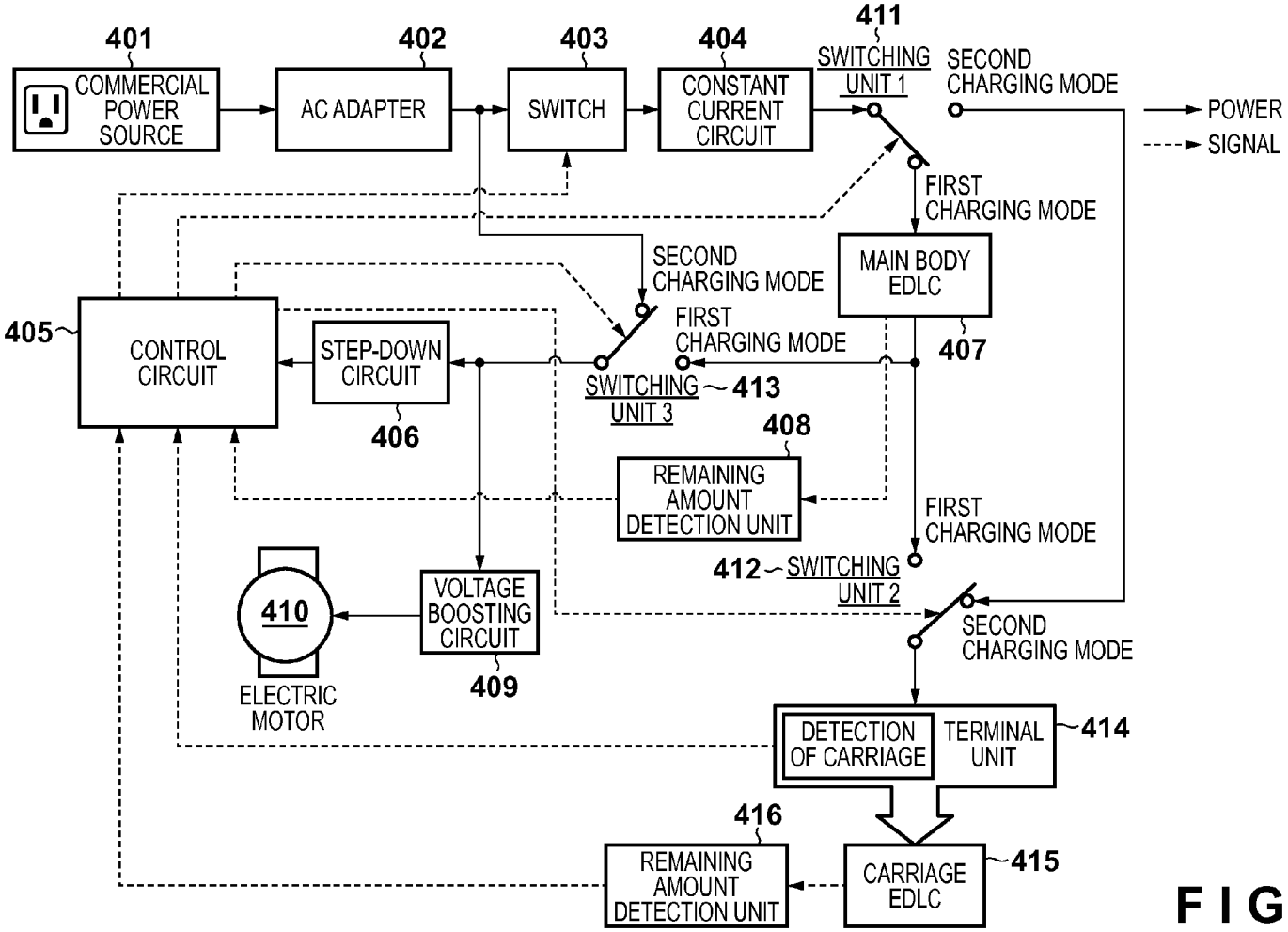
FIG. 8 is another diagram illustrating settings of the switching units in the case where it has been detected that a carriage EDLC has been fully charged.

In the case where the remaining amount detection unit 416 detects that the carriage EDLC 415 has been fully charged, as shown in FIG. 8, the switching unit 411 is switched to the first charging mode so as to start charging the main body EDLC 407. At this time, the inkjet printing apparatus 100 is already ready to be driven. The switching unit 411 is also switched to the first charging mode in the case where it is detected during charging of the carriage EDLC 415 that the carriage 101 has been moved away from the terminal unit 414. With this configuration, switching is performed to charge the main body EDLC 407, and the arc discharge at the terminal unit 414 can be prevented. In the case where the remaining amount detection unit 416 detects that the voltage of the carriage EDLC 415 has reached to a voltage less than or equal to a predetermined voltage, the switching unit 411 is switched to the second charging mode so as to again charge the carriage EDLC 415 directly from the commercial power source.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-083320, filed Apr. 11, 2013, which is hereby incorporated by reference herein in its entirety.

What is claimed is:

1. An apparatus comprising:

a control unit configured to control a switch that performs switching between a charging path for charging a first power storage unit provided in a carriage having a printhead mounted thereon by power supplied from a power source and a charging path for charging the first power storage unit by power supplied from a second power storage unit that is provided in a main body of a printing apparatus equipped with the carriage and has a capacity higher than the first power storage unit; and a determining unit configured to determine whether or not the second power storage unit has a power storage capacity less than a threshold value, wherein the control unit controls the switch such that the first power storage unit can be charged by the power supplied from the power source if it is determined by the determining unit that the power storage capacity of the second power storage unit is less than the threshold value.

2. The apparatus according to claim 1, wherein the second power storage unit is capable of being charged by the power supplied from the power source.

3. The apparatus according to claim 1, wherein the control unit controls the switch such that the second power storage unit can be charged by the power supplied from the power source after the first power storage unit has been fully charged in a case where the second power storage unit is charged.

4. The apparatus according to claim 1, wherein if it is determined by the determining unit that the power storage capacity of the second power storage unit is greater than or equal to the threshold value, the control unit controls the switch such that the first power storage unit can be charged by the power supplied from the second power storage unit.

5. The apparatus according to claim 1, wherein in a case where a terminal of the first power storage unit contacts a terminal of the switch, the control unit controls the switch such that the first power storage unit can be charged by the power supplied from the second power storage unit.

6. The apparatus according to claim 1, wherein in a case where a terminal of the first power storage unit is spaced apart from a terminal of the switch, the control unit controls the switch not to connect to the charging path for charging the first power storage unit by the power supplied from the second power storage unit.

7. The apparatus according to claim 1, wherein the second power storage unit is capable of supplying power for driving the printing apparatus.

8. The apparatus according to claim 1, comprising the printhead.

9. The apparatus according to claim 1, wherein each of the first power storage unit and the second power storage unit is an electrochemical capacitor.

10. The apparatus according to claim 9, wherein the electrochemical capacitor is an electric double-layer capacitor (EDLC).

11. A computer-readable storage medium in which a program for causing a computer to function as the units of the apparatus according to claim 1 is stored.

12. A charge control method for a printing apparatus including a first power storage unit provided in a carriage having a printhead mounted thereon and a second power storage unit that is provided on a main body side, is capable of charging the first power storage unit and having a capacity higher than the first power storage unit, the charge control method comprising:

determining whether or not the second power storage unit has a power storage capacity less than a threshold value; and if it is determined in the determining step that the power storage capacity of the second power storage unit is less than the threshold value, controlling a switch that performs switching between a charging path for charging the first power storage unit by power supplied from a power source and a charging path for charging the second power storage unit from a power source of the printing apparatus, such that the first power storage unit can be charged by the power supplied from the power source.

* * * * *